US006257094B1

(12) United States Patent
Babich

(10) Patent No.: US 6,257,094 B1
(45) Date of Patent: Jul. 10, 2001

(54) ROOFING SHINGLE AND TAR PAPER STRIPPER

(76) Inventor: Walter Babich, 8030 45th Pl., Lyons, IL (US) 60534

( * ) Notice: Subject to any disclaimer, the term of this patent is extended or adjusted under 35 U.S.C. 154(b) by 0 days.

(21) Appl. No.: 09/549,427

(22) Filed: Apr. 14, 2000

Related U.S. Application Data

(63) Continuation of application No. 09/088,033, filed on Jun. 1, 1998.

(51) Int. Cl.[7] ..... E04D 15/00
(52) U.S. Cl. ..... 81/45; 30/170
(58) Field of Search ..... 81/45; 30/170; 299/36.1

(56) References Cited

U.S. PATENT DOCUMENTS 2,279,454 * 4/1942 Fischer ..... 30/170
4,880,491 * 11/1989 Jacobs et al. ..... 156/584
5,218,766 * 6/1993 Himebaugh ..... 30/170
5,863,100 * 1/1999 Martin ..... 299/37.1
5,893,304 * 4/1999 Carroll ..... 81/45

* cited by examiner

*Primary Examiner*—Joseph J. Hail, III
*Assistant Examiner*—David B Thomas
(74) *Attorney, Agent, or Firm*—Patnaude & Videbeck

(57) ABSTRACT

A hand operated manual tool for removing roofing materials from the roof of a building is disclosed. The tool includes a central member or spine having a handle on one end and a cross brace positioned transversely on an opposing end thereof A plurality of elongate tines are selectably releasably secured in spaced relation along the length of the cross member. A pair of wheels are depended from the cross member to allow a user to roll the tool across the roof of a building. A deflecting shield is mounted on the cross member adjacent the removable tines to aid in deflecting the roofing materials away from the hands of a user. The device allows a roofer to manually remove a greater quantity of roofing materials than heretofore possible using manual tools.

4 Claims, 7 Drawing Sheets

ROOFING SHINGLE AND TAR PAPER STRIPPER

This application is a continuation of copending application Ser. No. 09/088,033 filed Jun. 1, 1998 and which designated the U.S.

FIELD OF THE INVENTION

This invention relates to apparatus for stripping roofing material from building roofs and, more particularly, to a manually operable roofing shingle and tar paper stripper large enough to strip more than one roofing shingle at at time and yet small enough to be manually controlled by a user.

BACKGROUND OF THE INVENTION

Roofing shingle strippers have heretofore been of two main types. The first type is a manual stripper approximating the size of a spade-type shovel having serrations at the leading edge of the shovel for prying roofing nails from plywood boards. Such a stripper is shown at U.S. Pat. No. 4,203,210, issued May 20, 1980. Another shingle stripper is found in U.S. Pat. No. 4,324,042, issued Apr. 13, 1982, which includes a device shaped similar to a straight hoe with a chisel edge and a tab along one side of the chisel edge. A hydraulically operated shingle stripper having a spade type distal working end is shown at U.S. Pat. No. 4,691,439 issued Sep. 8, 1987.

The second type of stripper is larger and generally motor-driven. Such shingle strippers are shown at U.S. Pat. No. 4,091,535, issued May 30, 1980 and U.S. Pat. No. 5,009, 131, issued Apr. 23, 1991. These motor-driven machines tend to be larger than the aforementioned manually operable strippers, and they include vibrating or oscillating front teeth with drives similar to those found in a hair clipper apparatus or in garden shears, It is an object of the present invention to provide a new and improved manually operable roofing shingle and tar paper stripper which is capable of removing shingles from a roof at a rate compatible with existing power operated devices.

SUMMARY OF THE INVENTION

Briefly, the present invention is embodied in a tool for stripping shingles from a roof. The tool has an elongated central member having a forward stripping end and a rearward end with a handle mounted thereon. A deflector shield is mounted on the central member with a plurality of tines extending from the forward end of the deflector shield which slide under shingles and strip them from the roof. Mounted beneath the deflector shield are a plurality of wheels such that the device may be rolled across a sloping roof.

A brake engages the wheels to stop the rotation thereof unless a brake disengagement lever is withdrawn by the operator. To operate the device, therefore, the operator must hold the disengagement lever to disengage the brake from the wheels. In the event the operator loses control of the tool, he will release the lever, and the brake will engage the wheel.

In the preferred embodiment, the wheels are adjustable to change the angle at which the tines will engage the surface to be stripped. A shield is also provided near the handle to protect the hands and arms of the operator from being hit by shingles and tar paper loosened by the tool.

BRIEF DESCRIPTION OF THE DRAWINGS

A better understanding of the present invention will be had after a reading of the following detailed description taken in conjunction with the following drawings wherein.

DETAILED DESCRIPTION OF A PREFERRED EMBODIMENT

Figure 1:
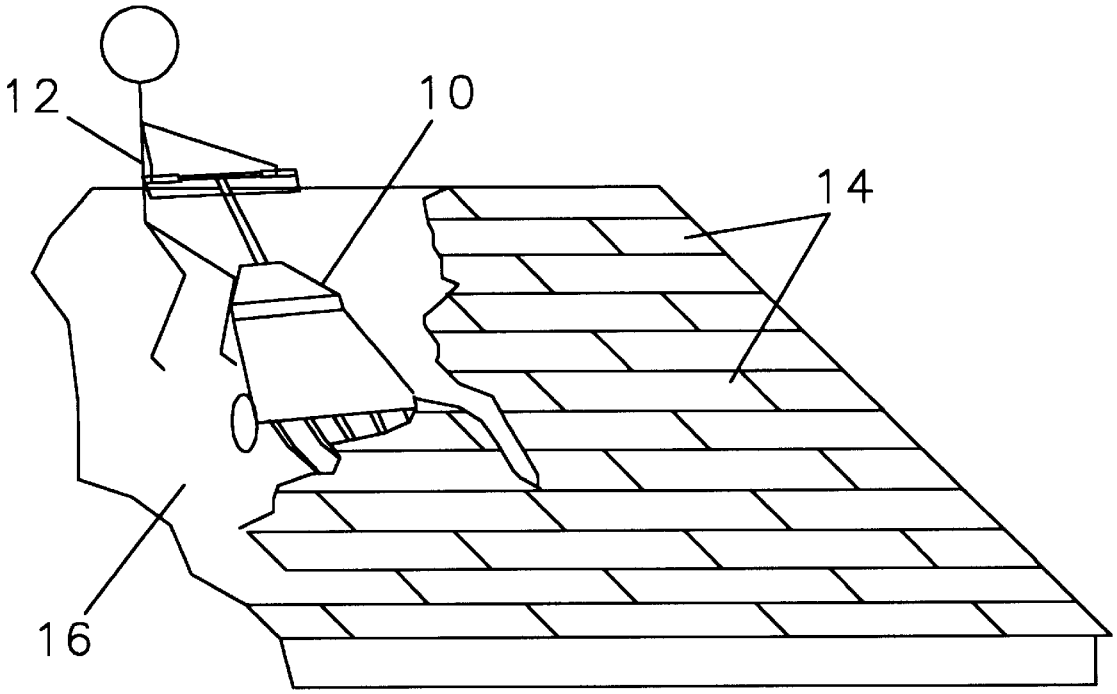
FIG. 1 is an isometric view of a tool in accordance with the present invention being used to strip shingles and tar paper from a portion of a roof.

Referring to FIG. 1, a roofing shingle scraping tool 10 is manually operable by an operator 12 to remove shingles 14 from a sloping roof 16. Prior to use, the operator will remove some of the shingles at the peak of the roof to provide a starting position for the tool. Thereafter, the tool will be moved downwardly and laterally along the roof 16 to remove the shingles therefrom.

Figure 2:
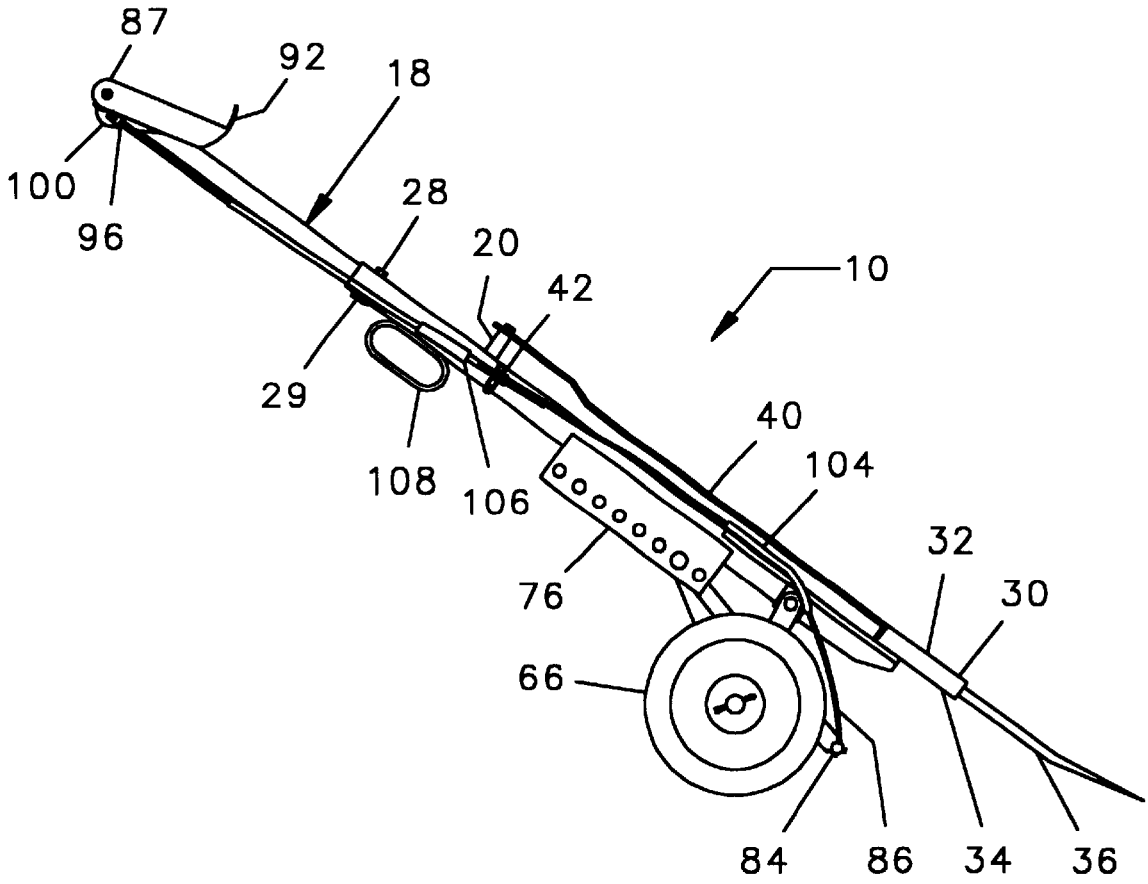
FIG. 2 is a side view of the shingle stripping tool shown in FIG. 1 with the brake disengaged and the wheels free to rotate.
Figure 3:
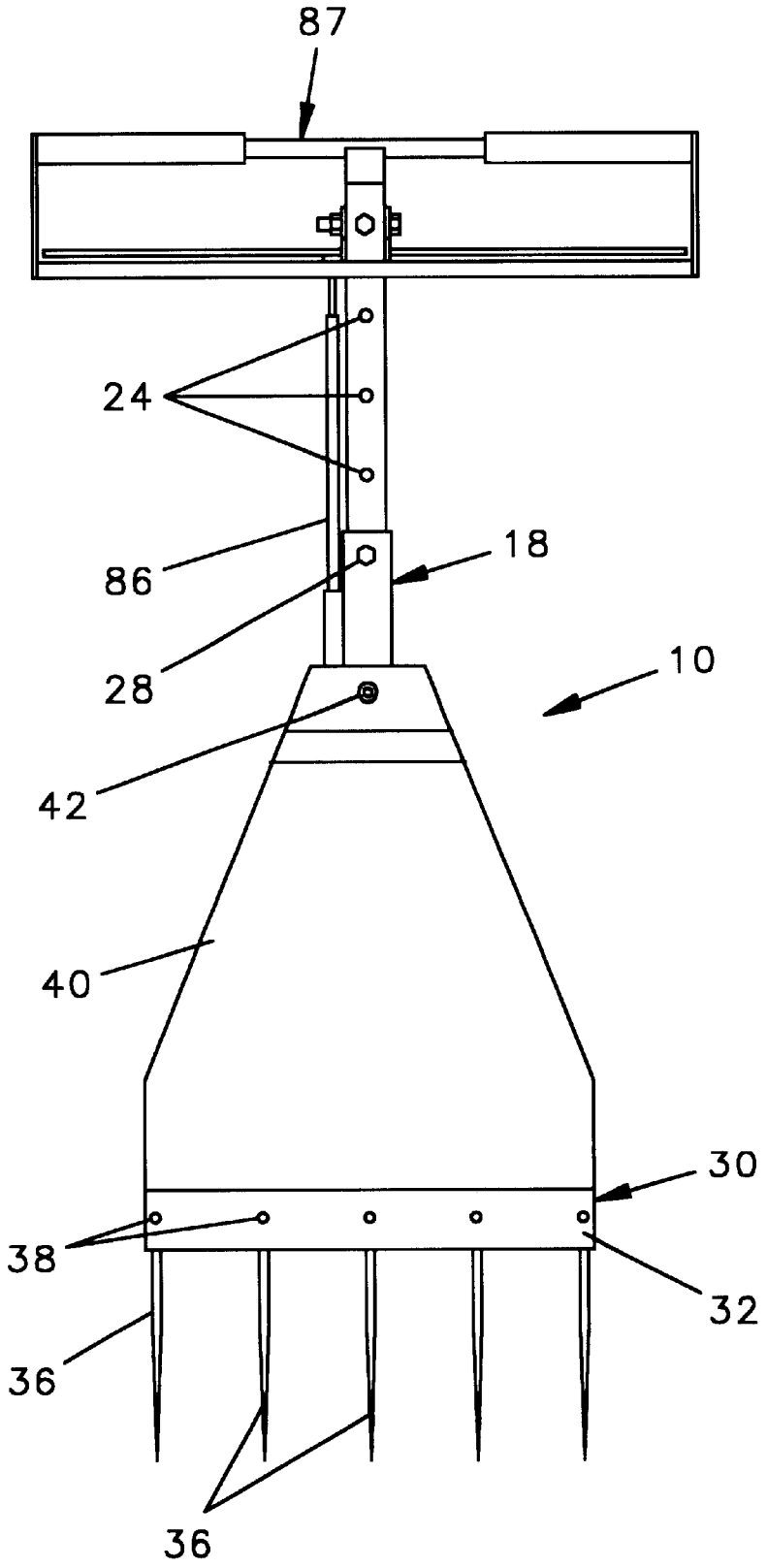
FIG. 3 is a top view of the tool shown in FIG. 1.

Referring to FIG. 2 and 3, the tool 10 has an elongated adjustable length central member 18 which includes a tubular forward portion 20 which slidably receives a rearward portion 22. The rearward portion 22 has a plurality of spaced holes 24–24 along the length thereof and the forward portion 20 has a single hole, not visible, at the rearward end thereof sized and positioned such that a retaining bolt 28 can be extended through the hole in portion 20 and one of the aligned holes 24–24 of the rearward portion 22, and secured by a nut 29 to thereby linearly lock the rearward portions 20, 22 with respect to one another. The length of the central member 18 may be adjusted by removing the locking bolt 28 and telescoping the rearward portion 22 with respect to the forward portion 24 to size the tool for the convenience of the operator, after which the bolt 28 is reinserted to retain the portions in their desired relationship.

Extending transversely across the forward end of the forward portion 20 is a generally rectangular metal retainer 30 having upper and lower plates 32, 34, respectively. Extending forwardly from the retainer 30 are a plurality of parallel. spaced tines 36—36, each of which extends through an aperture in the forward end of the retainer 30 and each tine 36—36 is retained in position by an associated retaining bolt 38—38. Each of the retaining bolts 38—38 passes through aligned holes in the upper and lower plates 32, 34, respectively, and a corresponding hole in the associated tine 36 to thereby retain the tine 36 within the retainer 30. Extending rearwardly of the retainer 30 is a generally planar shield 40, the rearward end of which is attached by a bolt 42 to a spacer 44 mounted on the rearward end of the forward portion 20 of the central member 18.

Figure 4:
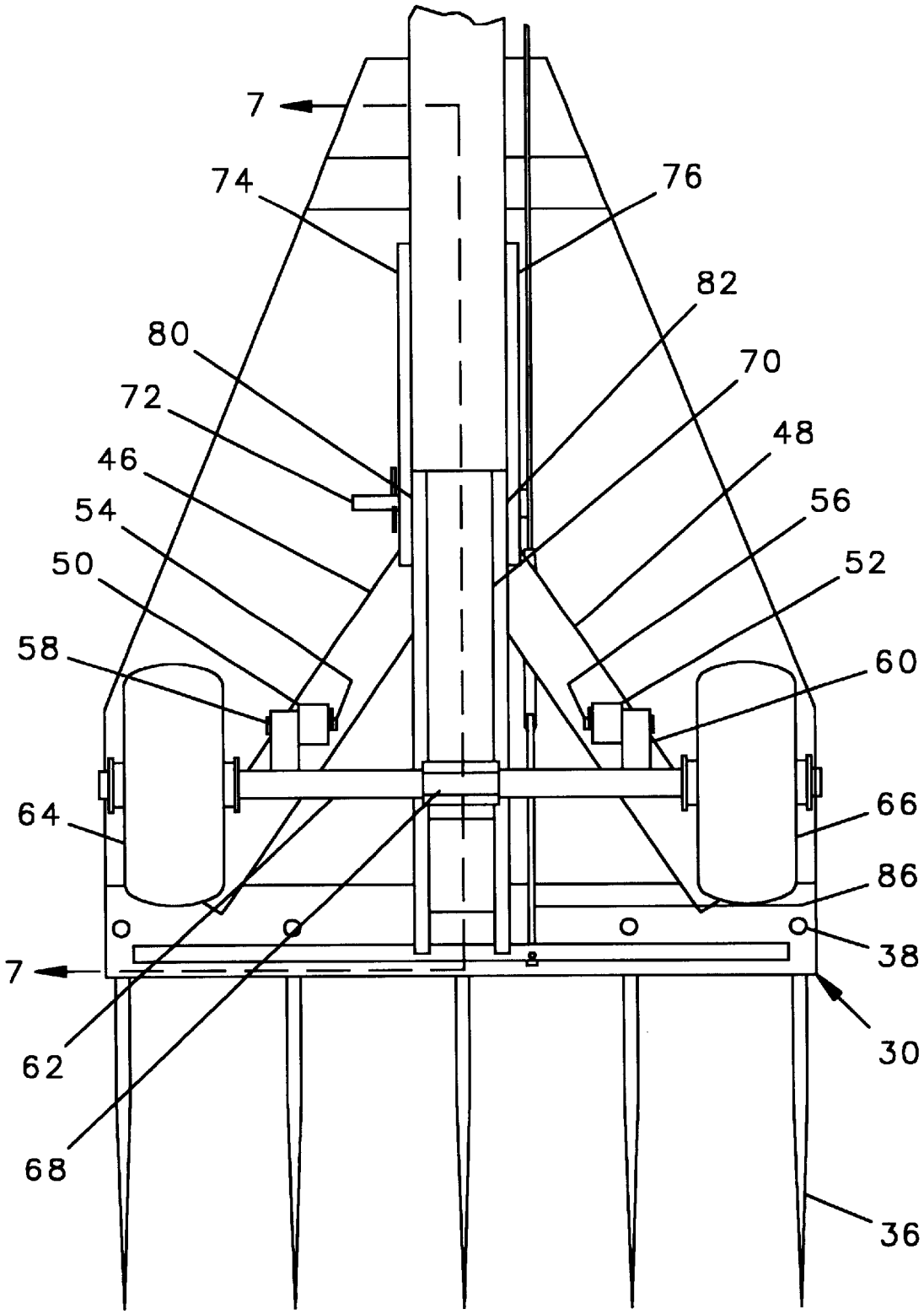
FIG. 4 is a fragmentary enlarged bottom view of the stripping end thereof.
Figure 7:
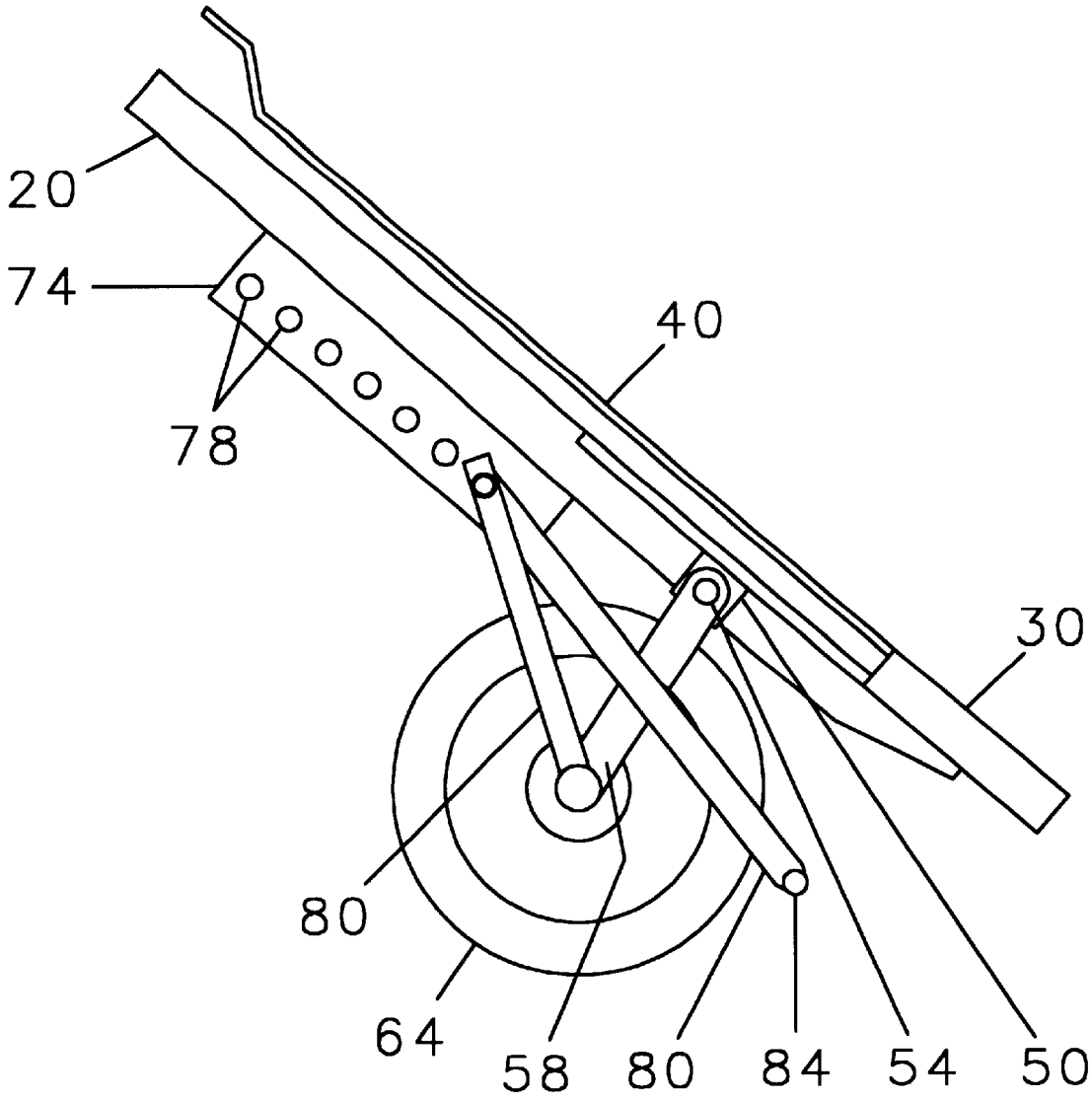
FIG. 7 is an enlarged fragmentary cross-sectional view taken through line 7—7 of FIG. 4.

Referring to FIGS. 4 and 7, extending from midway along the length of the forward portion 20 to each end of the retainer 30 are a pair of metal braces 46, 48. Mounted on each of the braces are pivots 50, 52, each of which has a transverse hole extending therethrough for retaining a pivot pin 54, 56, respectively. Pivotally mounted on the pins 54, 56 are the upper ends of pivot arms 58, 60, respectively, and extending across the lower ends of the pivot arms 58, 60 is an axle 62. At each of the ends of the axle 62 are mounted wheels 64, 66.

Centrally located on the axle 62 is a sleeve 68, and welded to the sleeve 68 is a bar 70 having a transverse hole at the second end thereof for receiving a pin 72. Mounted on each side of the forward portion 20 are opposing retaining plates 74, 76, each of which has a plurality of spaced holes 78—78 along the length thereof. The pin 72 extends through aligned holes in the plates 74, 76 and the second end of the bar 70 to retain these parts with respect to one another. By choosing the pair of aligned holes 78—78 through which the pin 72 is to be inserted, the position of the wheels 64, 66 can be oriented forwardly or rearwardly with respect to the central member 18, and the angle of the tool 10 with respect to the underlying roof 16 can thereby be adjusted.

Figure 5:
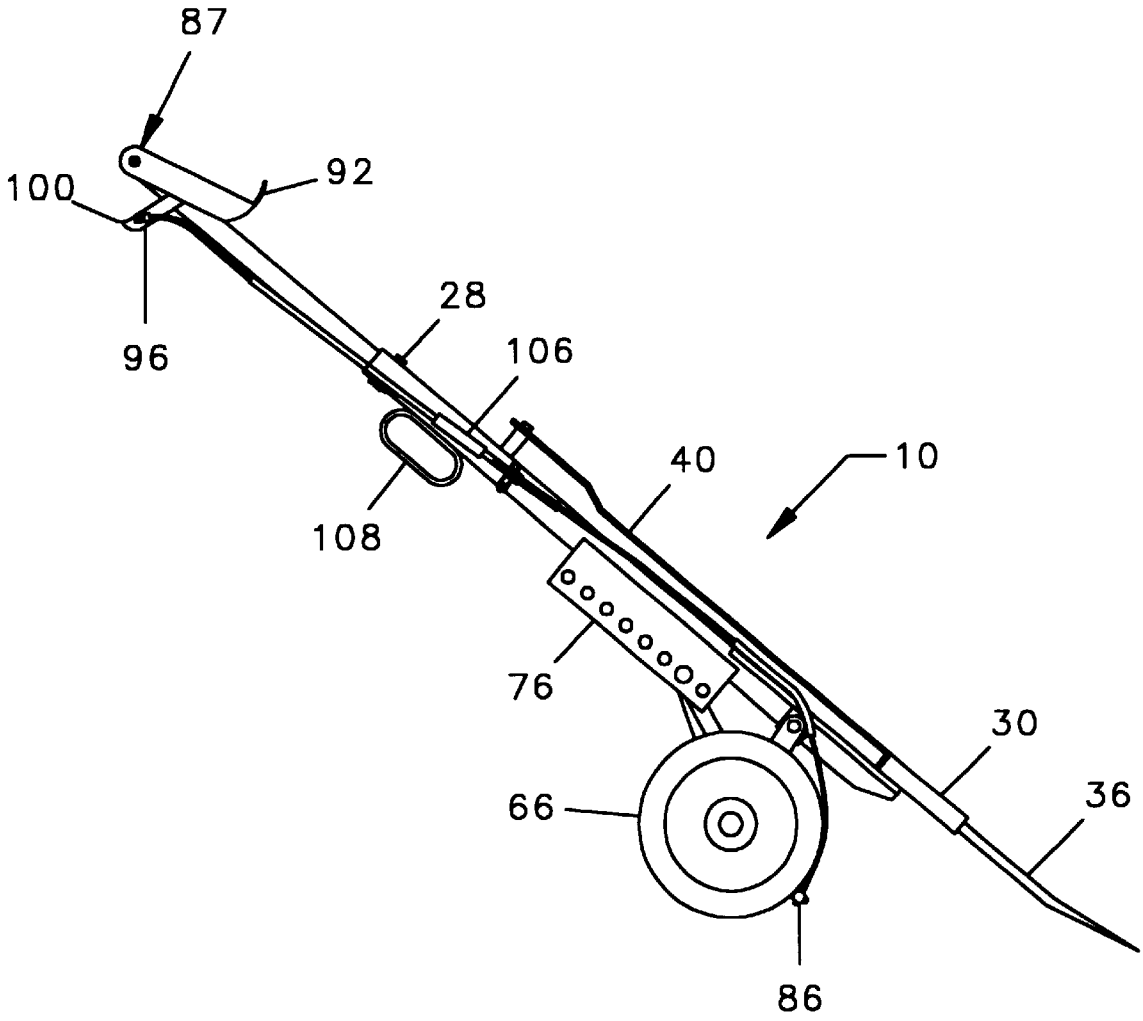
FIG. 5 is a second side view of the tool shown in FIG. 1, with the brake lever released and the brake in engagement against the wheels thereof.

As best shown in FIGS. 2 and 5, the pin 72 which extends through aligned holes in the retaining plate 74, 76 and through the second end of the bar 70 also extends through an aligned hole in the rearward end of each of a pair of brake pivot arms 80, 82. The forward ends of the arms 80, 82 are welded to a transverse brake bar 84, and the pivot arms 80, 82 permit the brake bar 84 to pivot toward and away from the outer surface of the wheels 64, 66 to provide a brake. As shown in FIG. 2, a first end of a cable 86 is attached to the brake bar 84, and during the operation of the tool 10, tension is maintained on the cable 86 to retain the brake bar 84 in an elevated position, as further described below. As shown in FIG. 5, when tension on the cable 86 is released, the brake bar 84 will wedge against the wheels 64, 66, and lock them against rotation.

Figure 6:
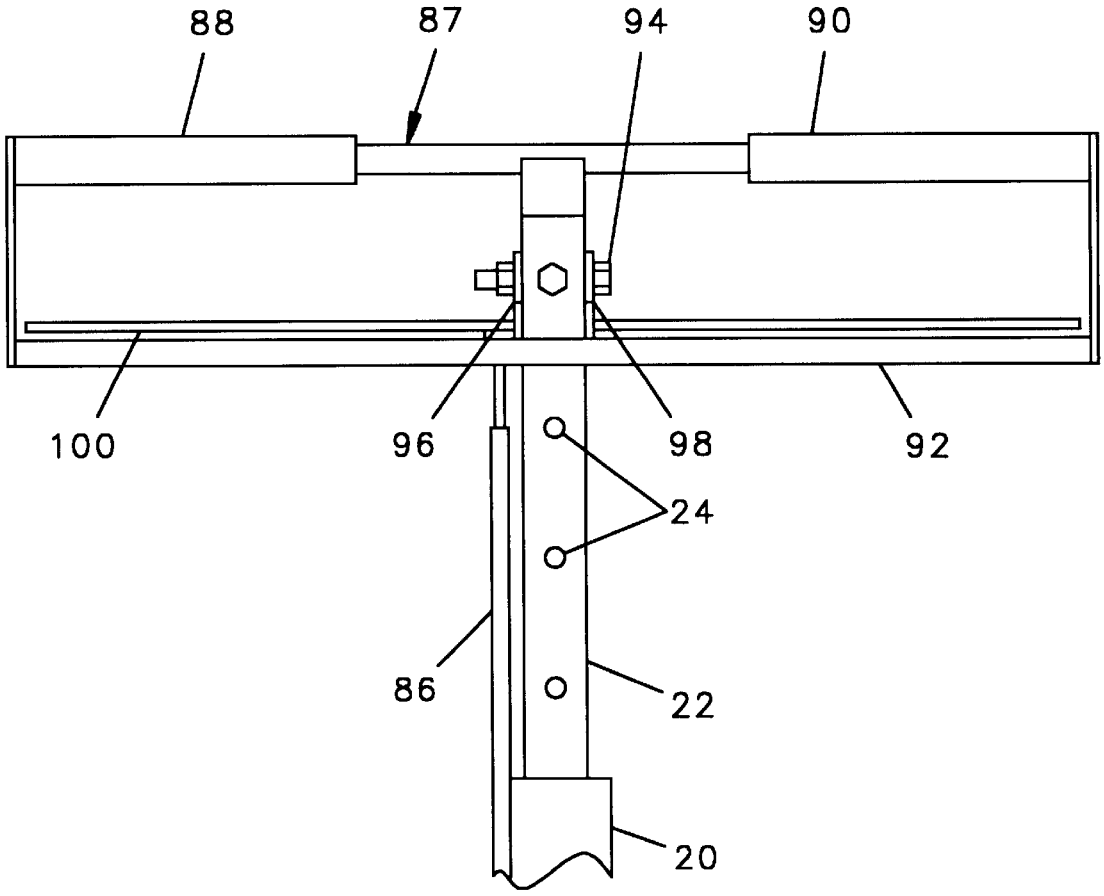
FIG. 6 is a fragmentary enlarged top view of the tool showing the handle thereof.

Referring to FIGS. 2, 5 and 6, at the rearward end of the rear portion 22 is a handle bar 87, and at the outer ends of the handle bar 87 are cushioned portions 88–90 suitable for grasping by the operator to control the tool 10. An elongate hand shield 92 is positioned forward of the handle bar 86 and parallel thereto to protect the hands of the operator from debris loosened by the tines 36—36. A pivot pin 94 extends through the rearward end of the rear portion 22 pivotally attaches a pair of arms 96, 98 having a brake release bar 100 mounted across the ends thereof. Attached to the brake release bar 100 is the second end of the cable 86. The cable 86 extends through guides 102, 104, and the length of the cable 86 is adjustable by threading or unthreading a conventional adjustment screw 106 positioned midway along the length thereof. The pivot arms 96, 98 are mounted such that gravity will cause the brake release bar 100 to fall to the position shown in FIG. 5 unless it is retained in the elevated position shown in FIG. 2 by the operator's hands which are wrapped around both the handle bar 87 and the brake release bar 100. When the brake release bar 100 is in the elevated position, the cable 86 is drawn through the guides 102, 104 to elevate the brake bar 84 thereby permits the wheels 64, 66 to turn. When the bar 100 is released by the operator, as will occur if the operator loses control of the tool 10, the tension in the cable 86 is released and the brake bar 84 will lock the wheels against rotation. The tool 10 further includes a metal loop 108 welded to the lower side of the forward portion 20 to which a cable, not shown. The other end of the cable can be secured to the roof of the structure being stripped or to a chimney to thereby prevent loss of the machine off the roof.

During operation of the tool 10, the length of the central member 18 is adjusted by sliding the forward and rearward portions 20, 22 with respect to each other and locking them in their desired orientation with the locking bolt 28. The wheels 64, 66 are similarly positioned in their desired orientation by removing and reinserting the retaining pin 72 in the appropriate holes 78—78 in the plates 74, 76. Once the tool is oriented in its desired configuration, the operator can begin removing shingles and tar paper from a roof.

Typically, the operator will begin the removal process by removing a portion of the shingles and tar paper at the apex of a roof of a structure. Thereafter, the tool would be positioned with the wheels on the roof and the tines 36—36 positioned under the tar paper and shingles to be removed. The operator would then withdraw the brake bar 100 to release the brake from the wheels and push the tool 10 downward along the slope of the roof. As the tool 10 moves, the tines 36, 36 will slide beneath the tar paper and shingles of the roof 16 and cause the removed portions to slide along the shield 40. The hand shield 92 will protect the operator's hands on the cushioned handles 88, 90 from being struck by loose shingles and materials stripped from the roof.

In the event the operator loses control of the tool 10, and releases the brake bar 100, gravity will draw the braking bar 84 against the outer surfaces of the wheels 64, 66 to prevent the tool from rolling down a roof. The tool can further be retained by an appropriate rope or the like attached to the loop 108.

While one embodiment of the present invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A tool for stripping roofing shingles from a roof comprising, an elongate central member having a rear end and a forward end, said forward end including an elongate cross member mounted transversely on said central member, a plurality of elongate tines positioned in evenly spaced relation across the length of the cross member and generally parallel to said central member, each of said tines being individually selectably releasably secured on said cross member, handle means transversely mounted on said rear end of said central member for being grasped by both hands an operator to control said tool, means on said elongate central member for deflecting material loosened by said plurality of tines away from said handle means when said tines are pushed under said roofing shingles of said roof, wheel mounting means depending from said central member for attaching a pair of wheels thereto, a pair of wheels mounted on said wheel mounting means in evenly spaced relation from said central member for allowing said tool to roll across said roof said handle means, said central member, said cross member and said elongate tines as secured on said cross member being positioned in substantially planer relation for transferring force applied and said handle substantially completely and directly to said tines, and said wheel mounting means and said pair of wheels depending from said central member closer to said tines than said handle means for orienting said planer relation at an acute angle with said roof to aid in lifting shingles.

2. The tool in accordance with claim 1 wherein said means for deflecting is a deflector shield on said central member and adjacent said plurality of tines.

3. The tool in accordance with claim 1 wherein said wheel mounting means being positioned to depend from said central member substantially closer to said elongate tines than to said handle means for providing a mechanical advantage at said tines for lifting shingles when said handle is moved downwardly and said wheel mounting means acts as a fulcrum.

4. A tool for stripping roofing shingles from a roof comprising, an elongate central member having a rear end and a forward end, said forward end including an elongate cross member mounted transversely on said central member, a plurality of elongate tines positioned in evenly spaced relation across the length of the cross member and generally parallel to said central member, each of said tines being individually selectably releasably secured on said cross member, handle means transversely mounted on said rear end of said central member for being grasped by both hands an operator to control said tool, a deflector shield mounted on said elongate central member and adjacent said plurality of tines for deflecting material loosened by said plurality of tines away from said handle means when said tines are pushed under said roofing shingles of said roof, means depending from said central member including a smooth forward and roof engaging boundary thereof for aiding the sliding of said tool across said roof said handle means, said central member, said cross member and said elongate tines as secured on said cross member being positioned in substantially planer relation for transferring force applied and said handle substantially completely and directly to said tines, and said means depending from said central member being positioned closer to said tines than said handle means for orienting said planer relation at an acute angle with said roof to aid in lifting shingles.

* * * * *